US005397079A

United States Patent [19]

Strentz et al.

[11] Patent Number: 5,397,079

[45] Date of Patent: Mar. 14, 1995

[54] PROCESS FOR THE AUTONOMOUS POSITIONAL CONTROL OF GUIDED MISSILES

[75] Inventors: Wilfried Strentz, Unterschleissheim; Günther Bittner, Höhenkirchen-Siegertsbrunn, both of Germany

[73] Assignee: Deutsche Aerospace AG, Munich, Germany

[21] Appl. No.: 134,277

[22] Filed: Oct. 8, 1993

[30] Foreign Application Priority Data

Oct. 16, 1992 [DE] Germany ..... 42 34 878.1

[51] Int. Cl.[6] ..... F41G 7/00

[52] U.S. Cl. ..... 244/3.2

[58] Field of Search ..... 244/3.15, 3.2, 3.21; 342/62; 364/462

[56] References Cited

U.S. PATENT DOCUMENTS 4,470,562 9/1984 Hall et al. ..... 244/3.2

5,260,709 11/1993 Nowakowski ..... 244/3.2

*Primary Examiner*—Daniel T. Pihulic

*Attorney, Agent, or Firm*—McGlew and Tuttle

[57] ABSTRACT

Process for the autonomous positional control of guided missiles, which are to be launched from a carrier plane, but without the cooperation thereof, wherein data on the instantaneous position of the guided missile, as well as flight and target data are fed into a computer of the guided missile already on the ground. The initial data fed into the computer are continually updated with changing values from the inertial navigation and additional navigational aids and are further calculated to achieve autonomous flight guidance and self-guiding of the missile. An uninterruptible power supply of the guided missile is maintained beginning from the moment of data reception.

8 Claims, 5 Drawing Sheets

PROCESS FOR THE AUTONOMOUS POSITIONAL CONTROL OF GUIDED MISSILES

FIELD OF THE INVENTION

The present invention pertains to a process for the autonomous positional control of guided missiles.

BACKGROUND OF THE INVENTION

Prior-art guided missiles require for their flight guidance and self-guiding so-called inertial platforms, which are able to determine electrically processable values of changes in the roll angle, pitch angle and yaw angle in space. In addition, the inertial platform generally also determines acceleration values in the three body axes, from which the onboard computer is able to infer changes in flight velocity by integration. However, the onboard computer does not receive data on the absolute position in space, nor on the three velocity vectors.

The Polaris rockets according to U.S. Pat. No. 4,470,562 also contain such an inertial platform, but they are suitable only for underwater launching.

In air-to-ground systems known hitherto, the missile receives the missing data during carrier flight (as it is carried by a carrier plane) from the carrier plane by data transmission via an electrical interface. Planes which are not equipped with such an interface were therefore unable to be used for launching guided missiles.

Further, it has been known to be a problem with air to ground systems wherein the missile is activated at a late stage during fight. For example, pilots often hesitate to activate a missile prior to launch (arm the missile which basically amounts to providing power and data to the missile). However, if a missile is armed just 20 seconds prior to its use, there will not be enough time (or movement of the plane) to update the guidance system of the missile as the data transmission via the electrical interface is often used to recalibrate the various guidance sensors. If the missile is armed during level and stable flight, the data transmission via the electrical interface will not necessarily update and recalibrate to a great enough extent because of the stable and level flight.

SUMMARY AND OBJECTS OF THE INVENTION

The primary object of the present invention is to design a process for the autonomous positional control of guided missiles such that the guided missile can also be launched from a carrier plane which does not have devices for transmitting data to the guided missile, i.e., without cooperation or help from planes.

According to the invention, a process is provided for autonomous positional control of guided missiles which are to be launched from a carrier plane (air to ground), but without the cooperation of the carrier plane. The process comprises feeding data on an instantaneous position of the guided missile as well as information on the flight of the guided missile and target data, into a computer of the guided missile on the ground. The process further comprises continually updating the initial data entered into the computer with changing values from an inertial navigation and other navigational aids provided in the guided missile wherein these changing values are further calculated for performing autonomous flight guidance and self guiding of the missile. The process also includes maintaining an uninterruptible power supply of the guided missile beginning from the moment of data reception.

The data are preferably fed into the computer of the guided missile by a prelaunch device. The initial position of the guided missile in relation to north is stored by the onboard computer and this position is obtained from the electrical values of a compass aligned with the longitudinal axis. A compass is provided in the guided missile for use and the compass may also be coupled with the prelaunch device. The horizontal position of the guided missile is calculated by the onboard computer on the ground from the calculated values of acceleration transducers. In addition to data from the inertial navigation system, data is also provided from navigational aids such as a radar altimeter, Doppler velocimeter, satellite navigation (GPS), laser telemeter, infrared homing head, thruster control unit, and safety systems.

Consequently, the process according to the present invention offers the possibility of launching guided missiles even from a carrier plane which is unable, due to its limited technical possibilities, to transmit data on the instantaneous position of the guided missile, as well as additional flight and target data to the guided missile. According to the process, these data are fed into the computer of the guided missile already on the ground, so that the guided missile is able to navigate already upon leaving the ground by means of its inertial navigation and other navigational aids. A prelaunch device, which enters the data necessary for navigation into the computer of the guided missile, which computer continues to continuously calculate the changing values from the inertial navigation and the other navigational aids, is used as an aid according to the present invention. Thus, the navigational device knows its position even after a prolonged carrier flight, without needing further data from the plane.

To compensate errors occurring during prolonged carrier flight as a consequence of the rotation of the earth, the north direction is also fed into the navigational device prior to launching via a compass coupled with the prelaunch device. This value is also further calculated by means of the inertial navigation and the onboard computer until the end of the mission. The compass may either belong to the missile, or it may also be part of the prelaunch device (the carrier plane etc.). The horizontal position of the guided missile is determined by the onboard computer from the values at rest from the acceleration transducer, i.e., from the components of the gravitational acceleration. The guided missile need not be oriented horizontally for this purpose, because it is sufficient to store the initial position.

The autonomous flight guidance and self-guiding of the guided missile begins immediately after reception of the data from the prelaunch device. It is therefore necessary to ensure an uninterruptible power supply for the inertial platform and the onboard computer from that moment on. This is done with an electric battery, which remains switched on from the time of transmission of the initial data and is continuously in operation as a buffer battery to prevent data loss even during prolonged flights, when the power should be supplied by the airborne supply system of the carrier plane.

To accomplish the mission of the guided missile, data for the following navigational aids—radar altimeter, Doppler velocimeter, satellite navigation (GPS), laser telemeter, infrared homing head, thruster control unit, and safety system—can also be fed into the computer, besides data for inertial navigation.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS In the drawings.

Figure 3B:
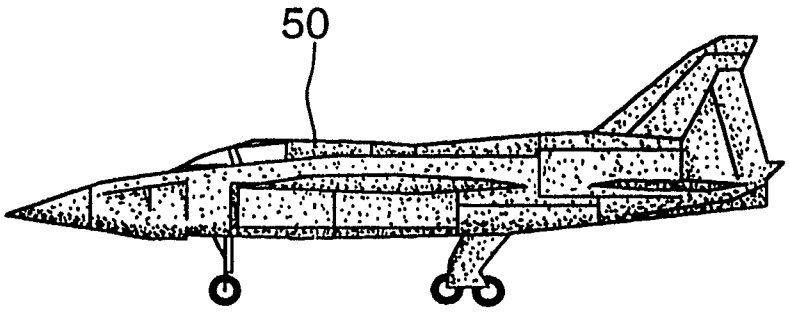
Figure 3A:
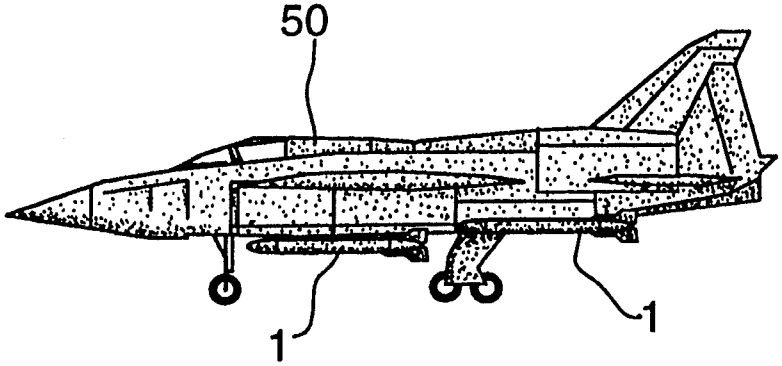
Figure 4:
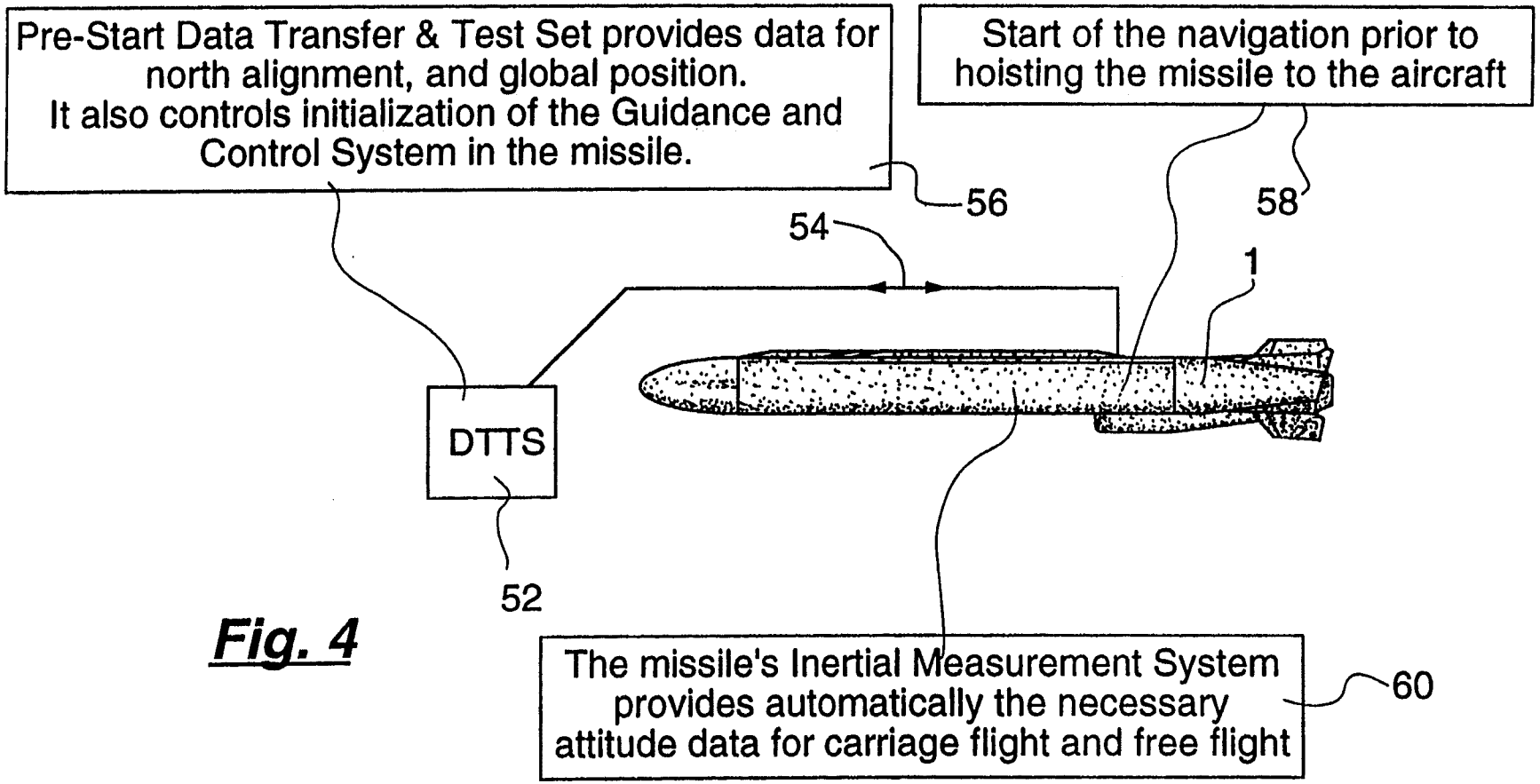
Figure 5:
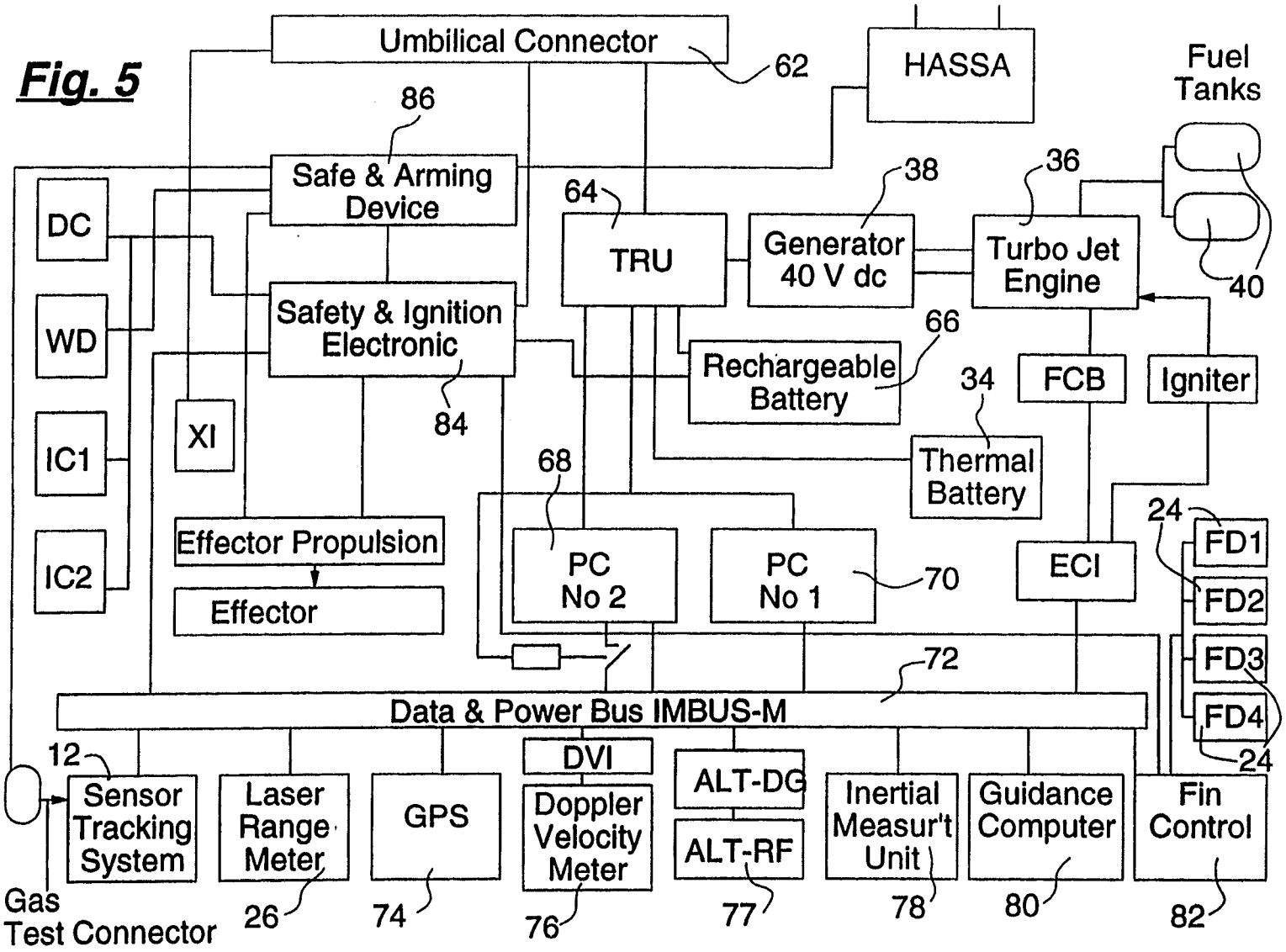
Figure 6:
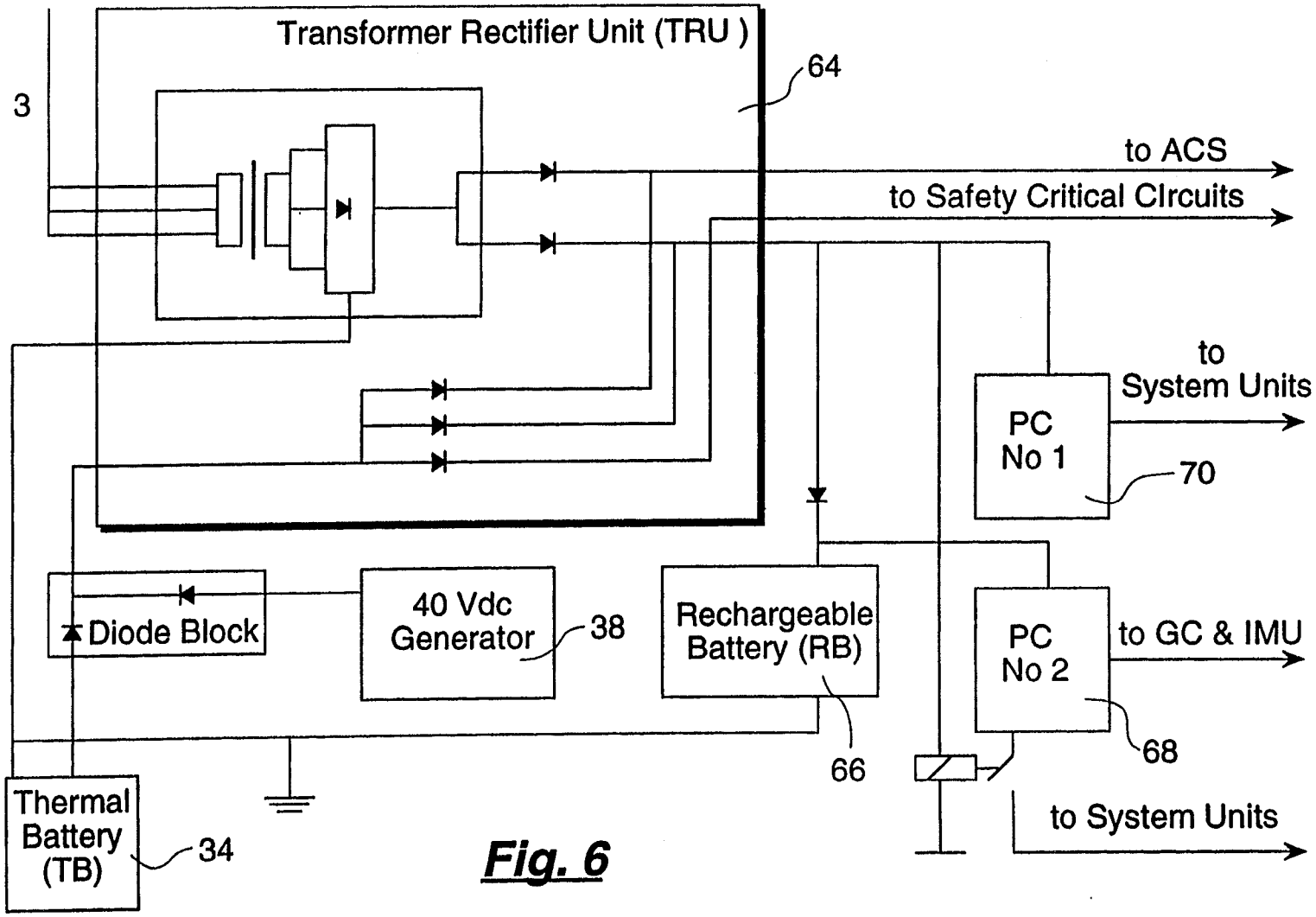

FIG. 3*a* is a side view of a strike aircraft with guided missiles which perform their navigation autonomously FIG. 3*b* is a side view of a strike aircraft in a stand-by state;

FIG. 4 is a schematic diagram showing the pre-start data transfer and test set providing data to the guided missile, prior to being connected to a carrier plane;

FIG. 5 is a block diagram showing a data and power bus according to the invention with connected sensor, computer and other components according to the invention; and FIG. 6 is a circuit diagram showing the power subsystem including thermal battery and transformer rectifier unit.

DETAILED DESCRIPTION OF THE PREFERRED EMBODIMENT

Figure 1:
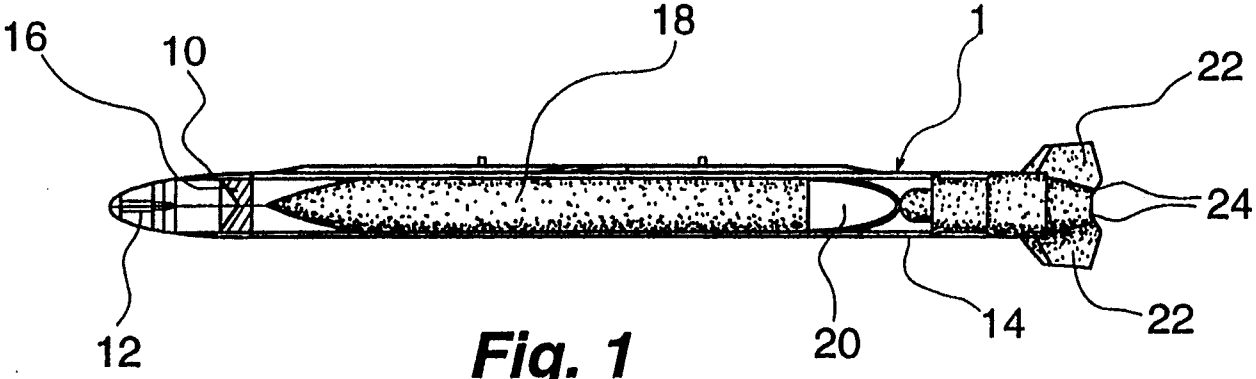
FIG. 1 is a side cut-away view of a guided missile according to the invention.

FIG. 1 shows a side cut-away view of a guided missile which is generally designated 1. A global positioning system antenna 10 is provided for receiving global positioning system signals from satellites and the like. The missile includes a sensor tracking system 12 as well as a Doppler velocity altimeter 14. The guided missile also includes a precharge 16, a penetrator main warhead 18, a combustion chamber with effector of propulsion 20 and fins 22 as wells as fin drives 24.

Figure 2:
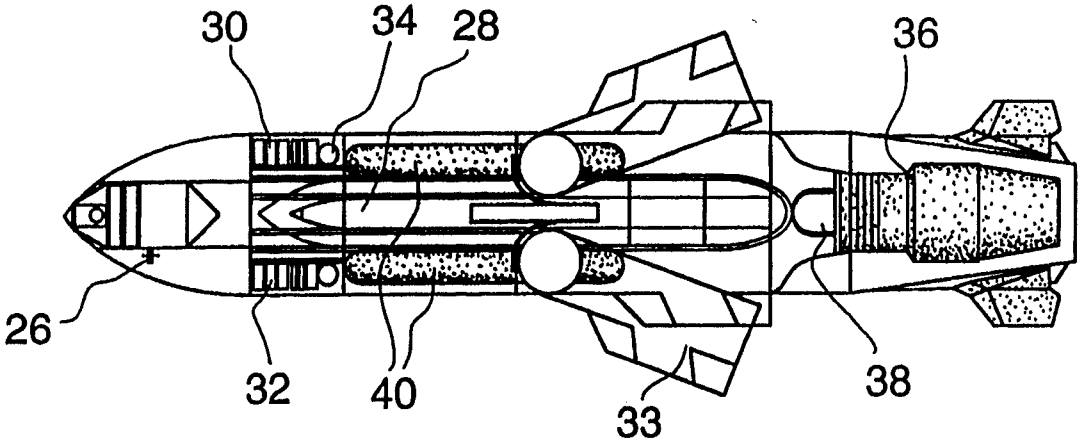
FIG. 2 is a top schematic view of the guided missile.

As can be seen from FIG. 2, a number of sensors and various means for navigation are provided including a laser range meter 26, a dovetail to fit a gyrocompass for north alignment 28 and an array on each side including fin control, the guidance computer, inertial measurement unit, global positioning system, laser range meter sensor tracking system, etc. Preferably GCP 2 includes the fin control, guidance computer, inertial measuring unit TI at 30 and GCP 1 includes the global position system laser range meter, a sensor tracking system and PCU at 32. A thermal battery 34 is provided which thermal battery provides an independent power supply (independent of the carrier aircraft). As seen in FIG. 2, the guided missile also includes a turbojet engine 36 and electrical power generator 38 and fuel tanks 40.

FIG. 3*a* shows the carrier aircraft 50 with missiles under the aircraft wherein the aircraft is in flight and the missiles 1 perform their navigation autonomously, completely separate from the carrier plane 50. For release of the missiles, it is not necessary to transfer further mission data with respect to velocity, altitude, and target.

FIG. 3*b* shows the carrier aircraft 50 in a stand-by mode without the guided missiles I and prior to carrying forth the process of the invention.

The process of the invention is described schematically with reference to FIG. 4. As shown in the diagram of FIG. 4, there is a pre-start data transfer and test set transfer prior to connecting to the missile to the stand-by aircraft or prior to initiation of the flight with the carrier aircraft. The test set provides data for north alignment and global position. The pre-start data transfer test set is also to control initialization of the guidance and control systems in the missile 1. As seen at box 52, the data transfer and test set controls the initialization of the guidance and control system as depicted by transfer line and arrows 54. Box 56 provides an explanation of this data transfer and box 58 notes the start of the navigation prior to hoisting the missile to the aircraft as a preferred aspect of the process of the invention. Box 60 then notes that the missiles inertial measurement system provides automatically the necessary altitude data for carriage flight and free flight of the missile.

FIG. 6 is a block diagram showing the preferred system according to the invention including the main umbilical connection 62 providing an electrical connection and safe/arming connection etc. between the guided missile 1 and the carrier plane 50. The umbilical connection connects to a transformer rectifier unit 64 providing power to the guided missile from the carrier plane. However, according to the invention, the rectifier is also connected to an independent power source such as thermal battery 34 and rechargeable battery 66 to provide flexibility as to power which guarantees an independent power source for the guided missile in order to run the autonomous navigational system. As shown in FIG. 5, the generator 38 is connected to the transformer rectifier unit 64 for recharging rechargeable battery 66. Power is provided via control units 68 and 70 to a data and power bus 72. The data and power bus provides power to the various navigation elements including sensor tracking system 12, laser range meter 26, global positioning system 74 connected to global positioning system antenna 10, Doppler velocimeter 76 (associated with the Doppler velocity altimeter) and inertial measuring unit 78, guidance computer 80 and fin control 82. The fin control 82 is also connected to the safety and ignition electronic unit 84 and the safe and arming device 86. The fin control 82 is also connected to various fin drives 24.

FIG. 6 shows further detailed information regarding the electrical power subsystem of the invention, particularly the ability according to the invention to not rely on a connection 3 to the carrier airplane via the umbilical connector 62. Electrical power is provided by the carrier airplane and is transformed into the appropriate DC level by the transformer rectify unit 64. Power is then provided to the automatic control system, the safety circuits and also to power controls 68 and 70 providing power to the bus (to the system units etc.). However, the invention also provides an independent thermal battery 34 which allows the invention to be practiced wherein according to a preferred form of the process, flight guidance and self guiding of the guided missile begins immediately after reception of the data and preferably even before the missile is hoisted to the aircraft.

The process according to the invention provides a data feed into the guidance computer 80 while the missile is already on the ground (preferably even before it is hoisted to the carrier plane 50) whereupon the missile is ready to navigate upon leaving the ground by the internal navigation and navigational aids described above. This process uses a prelaunch device which enters the data necessary for navigation into the computer 80 and then the computer 80 continuously calculates the changing values from the inertial navigation and other navigational aids.

To compensate for errors occurring during prolonged carrier flights (as a consequence of rotation of the earth and the like), the north direction is also fed into the navigational device via a compass coupled to the prelaunch device. The horizontal position is calibrated as to the guided missile by the onboard computer from the values at rest from the acceleration transducer, i.e., from the components of the gravitational acceleration. In this regard, the guided missile need not be oriented horizontally but it is sufficient to store the initial position. The autonomous guidance in self guiding of the guided missile begins immediately after reception of the data from the prelaunch device. An uninterrupted power supply is therefore essential according to the invention and in this regard the thermal battery 34 as well as a chargeable battery is provided wherein power supply from the time of transmission of the initial data and continues to prevent any data lost even during prolonged flights (even if power is interrupted from the carrier plane).

The system is described with regard to the various navigational devices shown. The various navigational aids may be provided including a radar altimeter (radio frequency altimeter 77, Doppler velocimeter 76), satellite navigation (GPS) 74, laser telemeter, infrared homing head, thruster control unit, safety system, etc., all data being fed to the computer via the data bus 72, besides just the inertial navigation data.

While a specific embodiment of the invention has been shown and described in detail to illustrate the application of the principles of the invention, it will be understood that the invention may be embodied otherwise without departing from such principles.

What is claimed is:

1. A process for the autonomous positional control of guided missiles, the guided missiles being launched from a carrier airplane, without cooperation from the carrier airplane, the process comprising the steps of:

feeding data on instantaneous position as well as flight and target data into a computer onboard the guided missile, the data being fed while the guided missile is on the ground;

carrying the guided missile into the air, with the carrier airplane;

continually updating the initial data entered into the computer, after said step of feeding data, by providing changing values without cooperation from the carrier airplane, the changing values being provided from an inertial navigation system including one or more navigational aids provided onboard the guided missile, said values being further calculated for performing autonomous flight guidance and self guiding of the missile; and maintaining a power supply onboard the guided missile beginning from the moment of data reception and continuing during a duration of a mission.

2. A process according to claim 1, wherein:

the initial data is fed into the computer of the guided missile by a prelaunch device.

3. A process according to claim 1, wherein:

the initial position of the guided missile in relation to north is stored by the onboard computer and this initial position is obtained from electrical values supplied by a compass aligned with a longitudinal axis of the guided missile.

4. A process according to claim 3, wherein:

a compass provided in the guided missile is used for said storing of said initial position.

5. A process according to claim 3, wherein:

a compass coupled with said prelaunched device is used to store said initial position.

6. A process according to claim 1, wherein:

said horizontal position of said guided missile is calculated by said onboard computer on the ground from calculated values of acceleration transducers.

7. A process according to claim 1, wherein:

in addition to said inertial navigation system, additional navigational aids are provided include one of a radar altimeter, Doppler velocimeter, satellite navigation (GPS) laser telemeter, infrared homing head, thruster control unit, safety system, data from said additional navigational aids being fed into said computer of said guided missile.

8. A process for the positional control of a guided missile, the process comprising the steps of:

providing a computer on board the guided missile and providing one or more navigational aids on board the guided missile;

feeding data on instantaneous position as well as flight and target data into the computer, the data being fed while the guided missile is on the ground;

connecting the guided missile to a carrier airplane and subsequent to said step of feeding data, carrying said guided missile into the air, with the carrier airplane;

updating the initial data entered into the computer, said step of updating commencing after said step of feeding data and continuing while said guided missile is connected to said airplane, by providing changing positional values without interaction with the carrier airplane, the changing positional values being provided from an inertial navigation system including one of said navigational aids provided on board the guided missile;

separating said guided missile from said carrier airplane and further calculating changing values for performing autonomous flight guidance and self guiding of the guided missile; and maintaining a power supply on board said guided missile, said power supply being maintained in an operational state from a time of data reception and continuing in an operational state for a duration of a mission.

* * * * *